US007040260B2

(12) United States Patent
Yoshimatsu et al.

(10) Patent No.: US 7,040,260 B2
(45) Date of Patent: May 9, 2006

(54) LIQUID-COOLED, VERTICAL SHAFT TYPE COMBUSTION ENGINE

(75) Inventors: Atsuhiro Yoshimatsu, Akashi (JP); Keiichi Nakamizo, Hyogo (JP); Takao Sasamura, Akashi (JP); Minoru Nakamura, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/965,620

(22) Filed: Oct. 14, 2004

(65) Prior Publication Data

US 2005/0081803 A1 Apr. 21, 2005

(30) Foreign Application Priority Data

Oct. 17, 2003 (JP) ..... 2003-357764

(51) Int. Cl.
*F01P 7/04* (2006.01)

(52) U.S. Cl. ..... 123/41.65; 123/41.49

(58) Field of Classification Search ..... 123/41.49, 123/41.65, 198 E, 196 W, 41.57, 41.58, 41.56, 123/41.47, 41.66, 41.62
See application file for complete search history.

(56) References Cited

U.S. PATENT DOCUMENTS

| | | | | |
|---|---|---|---|---|
| 4,756,280 | A | 7/1988 | Tamba et al. | |
| 4,862,981 | A * | 9/1989 | Fujikawa et al. | 180/68.4 |
| 4,946,482 | A | 8/1990 | Tamba et al. | |
| 5,711,387 | A * | 1/1998 | Murata et al. | 180/68.1 |
| 6,849,961 | B1 * | 2/2005 | Takizawa et al. | 290/1 A |

* cited by examiner

*Primary Examiner*—Henry C. Yuen
*Assistant Examiner*—Hyder Ali

(57) ABSTRACT

A liquid-cooled, vertical shaft type combustion engine is provided with a duct utilizing a stream of cooling air induced by a cooling fan to cool various parts of the combustion engine. The combustion engine includes an engine body, a crankshaft accommodated in the engine body so as to extend in a vertical direction, at least one engine cylinder head disposed at a front portion of the engine body, a radiator mounted above the engine body for circulating an engine coolant, a duct positioned below the radiator, and a cooling fan operatively accommodated within the duct. The duct has at least a front discharge opening and side discharge ports defined in a peripheral wall for discharging a stream of cooling air induced by the cooling fan, in a direction forwardly of the engine body and in a direction slantwise forwardly of the engine body.

17 Claims, 9 Drawing Sheets

LIQUID-COOLED, VERTICAL SHAFT TYPE COMBUSTION ENGINE

BACKGROUND OF THE INVENTION

1. Field of the Invention

The present invention generally relates to a liquid-cooled, vertical shaft type combustion engine mounted on a working vehicle such as a lawn tractor and, more particularly, to an improvement in a duct system of the liquid-cooled, vertical shaft type combustion engine, in which a cooling fan is accommodated, for enhancing the cooling performance.

2. Description of the Prior Art

As is well known to those skilled in the art, some lawn tractors currently available in the market make use of a liquid-cooled, vertical shaft type combustion engine. The liquid-cooled, vertical shaft type combustion engine generally includes a radiator arranged within an engine compartment below a bonnet or hood at a front region of the lawn tractor and above the engine, a cooling fan positioned below the radiator, a duct accommodating the cooling fan therein and an air cleaner unit disposed above the duct. See, for example, U.S. Pat. Nos. 4,946,482 and 4,756,280 issued Aug. 7, 1990 and Jul. 12, 1988, respectively, to Tamba et al. and assigned Kawasaki Jukogyo Kabusghiki Kaisha.

In the prior art liquid-cooled, vertical shaft type combustion engine such as disclosed in those USPs referred to above, since the radiator is positioned immediately above a vertically extending crankshaft, the arrangement is made such that a downwardly oriented stream of cooling air drawn by the cooling fan to pass through the radiator from above is directed to flow through the duct and is, after having been acutely deflected by an air stream guide disposed inside the duct, discharged to the outside from front of the working vehicle. With this arrangement, however, a smooth flow of the cooling air cannot be obtained. In view of this, a duct system including the radiator, the cooling fan and the duct is required to be large to cool the engine sufficiently.

Further, the duct according to the above mentioned U.S. Pat. No. 4,946,482 is a resin molded article and is formed to cover not only an outer peripheral portion of the cooling fan but also an underside of the cooling fan and is therefore required to be bulky in size. In addition, in view of a limitation imposed on the die molding, the duct has to be of a split construction including upper and lower duct components, resulting not only in increase of the number of assembling steps, but also in increase of costs for preparation of the dies. Yet, considering that the air induced by the cooling fan is discharged directly outside the combustion engine from a front outlet of the duct, it cannot be said that maximized utilization of the cooling air is attained in terms of cooling of various component parts of the combustion engine.

SUMMARY OF THE INVENTION

In view of the foregoing, the present invention is intended to provide a liquid-cooled, vertical shaft type combustion engine, which is compact in size and can be manufactured at a reduced cost, and which can exhibit an excellent cooling performance in which maximized utilization of a cooling air induced by a cooling fan to cool various component parts of the combustion engine can be attained.

In order to accomplish the foregoing object, a liquid-cooled, vertical shaft type combustion engine designed in accordance with the present invention includes an engine body, a crankshaft accommodated in the engine body and having a longitudinal axis oriented substantially vertically, at least one engine cylinder head disposed at a front portion of the engine body, a radiator mounted above the engine body for cooling the engine body, a duct positioned below the radiator, and a cooling fan operatively accommodated within the duct. The duct has top and bottom ends opening upwardly and downwardly, respectively, and has at least a front discharge opening and side discharge ports defined in a front portion and side portions, respectively, of a peripheral wall for discharging a stream of cooling air, induced by the cooling fan, in a direction forwardly of the engine body and in a direction slantwise forwardly of the engine body, respectively.

It is to be noted that the terms "forward" and "front" used in connection with the engine body and, also, the direction of flow of the stream of cooling air induced by the cooling fan are to be understood as meaning the direction in which the cylinder head mounted on the engine cylinder protrudes. It is also to be noted that where the combustion engine of the present invention is mounted on a working vehicle such as a lawn tractor, the front of the engine body and the front of the working vehicle may not coincide with each other.

According to the present invention, the duct can have a conveniently simplified structure opening upwardly and downwardly. The duct allows the stream of cooling air to smoothly flow therethrough at a substantially increased flow rate enough to permit the radiator to dissipate an increased quantity of heat that is transferred to the stream of cooling air. Accordingly, the radiator and the cooling fan may have a compact size, resulting in reduction in noise generated by the cooling fan.

Also, since the duct is of one-piece construction, not of a multi-piece construction using a combination of separate components, the number of component parts used can advantageously be reduced, accompanied by reduction in cost of manufacture thereof.

The combustion engine of the present invention may include a fuel supply device, in which case the front discharge opening confronts the fuel supply device.

According to this preferred structural feature, the fuel supply device can be cooled in contact with the stream of cooling air and, hence, the fuel supply device can operate in a stabilized manner.

The combustion engine of the present invention may also include an air cleaner unit disposed radially outwardly of the duct.

According to this structural feature, the air cleaner unit can have an increased dimension, i.e., thickness, as measured in a vertical direction, as compared with the air cleaner unit employed in association with the prior art combustion engine.

More specifically, since the duct hitherto employed has so large a horizontal dimension that no space is available laterally of the duct, the air cleaner unit is generally positioned above the duct and, in order to suppress the overall height of the combustion engine, the top surface of the air cleaner unit is held generally in flush with the top surface of the radiator with the vertical dimension of the air cleaner unit adjusted to a value corresponding to the thickness of the radiator.

In contrast thereto, according to the present invention, since the air cleaner unit is disposed radially outwardly of the duct, the vertical dimension of the air cleaner unit can be increased to a value generally corresponding to the thickness of the duct plus the thickness of the radiator while the overall height of the combustion engine is suppressed, i.e., not increased unduly. Thus, since the air cleaner unit can have an increased size in the vertical direction, a filter element accommodated in the air cleaner unit can have a correspondingly increased capacity to thereby enhance the air cleaning performance. Also, since the stream of cooling air emerging outwardly from the front discharge opening impinges upon and is then deflected by an air cleaner case so as to flow downwardly, a cooling effect to cool the fuel supply device such as a carburetor or a fuel injection device disposed below the air cleaner unit can be effectively increased.

In a preferred embodiment of the present invention, the duct may have a rear discharge opening defined in a rear portion of the peripheral wall of the duct and the combustion engine additionally includes a bracket for supporting the radiator on the engine body. This bracket concurrently serves as a guide plate that is positioned outwardly of and in the vicinity of the rear discharge opening for guiding a portion of the stream of cooling air in a direction laterally of the duct.

According to this feature, since the rear discharge opening is covered by the guide plate, the stream of cooling air emerging outwardly from the rear discharge opening is not discharged rearwardly towards the outside. Also, since the guide plate deflects a portion of the stream of cooling air to flow in a direction laterally of the duct, component parts of the combustion engine disposed laterally of the duct can be effectively and efficiently cooled by the stream of cooling air.

In another preferred embodiment of the present invention, the duct may include a guide body mounted therein and encircling at least an upstream portion of an outer periphery of the cooling fan accommodated within the duct.

According to this feature, it is possible to define a tip clearance of the cooling fan not between the duct and the cooling fan, but between the guide body, disposed inside the duct, and an outer periphery of the cooling fan, which tip clearance considerably affects the blow efficiency of the cooling fan and generation of noises of the cooling fan. Accordingly, by selecting the guide body appropriate to a given outer diameter of the cooling fan, a proper tip clearance can be secured and, therefore, not only can a desired cooling performance be obtained, but generation of noises of the cooling fan can also be suppressed. For example, in the case of changing a rated output (horsepower) of an engine, although a present cooling fan is replaced with a cooling fan of a different outer diameter that is suitable to obtain a cooling performance required for the engine having such changed rated output, the proper tip clearance can be easily obtained only by replacing a present guide body with a different size guide body appropriate for the new cooling fan, while a common duct is used.

In a further preferred embodiment of the present invention, the duct may include a louver provided in each of the side discharge ports for guiding the stream of cooling air to flow slantwise forwardly of the engine body.

This feature is particularly advantageous in that the stream of cooling air emerging outwardly from the side discharge ports can be forcibly guided to flow slantwise forwardly of the duct so that a high temperature region around the cylinder head can advantageously be cooled.

According to the present invention, the duct including the louvers may be formed of a synthetic resin with the use of a mold assembly having first and second die moving directions, which conform respectively to a vertical direction and a slantwise forward direction in which portions of the stream of cooling air emerge outwardly from the louvers.

According to this feature, the duct can be formed by means of a molding technique with the use of the specific mold assembly of a simplified construction and the cost of making the mold assembly can be suppressed and, therefore, the cost of manufacture of the duct can advantageously be reduced.

In a still further preferred embodiment of the present invention, the liquid-cooled, vertical shaft type combustion engine may be a V-type engine having engine cylinders disposed in a V-shape arrangement. In such case, respective portions of the stream of cooling air emerging outwardly from the side discharge ports of the duct are directed towards the engine cylinders of the V-shape arrangement.

According to this feature, since the engine cylinders of the V-shape arrangement and the associated cylinder heads, which are generally cooled by a coolant liquid circulating within them, are also cooled by those portions of the stream of coolant air, respectively, the capacity of cooling the engine cylinders and the associated cylinder heads can advantageously be increased.

In a still further preferred embodiment of the present invention, the liquid-cooled, vertical shaft type combustion engine of the present invention may further include a fuel pump disposed at a location below the side discharge ports in the peripheral wall of the duct.

According to this feature, the peripheral wall of the duct serves to insulate the fuel pump from radiant heat of the combustion engine then having an elevated temperature and, therefore, the fuel pump is not thermally affected by the combustion engine. Also, since the fuel pump is disposed at that location below the side discharge ports, the stream of coolant air emerging outwardly from the side discharge ports does in no way impinge on the fuel pump and, therefore, the fuel pump is not heated and is maintained at a proper temperature, enhancing the reliability of the pumping function.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
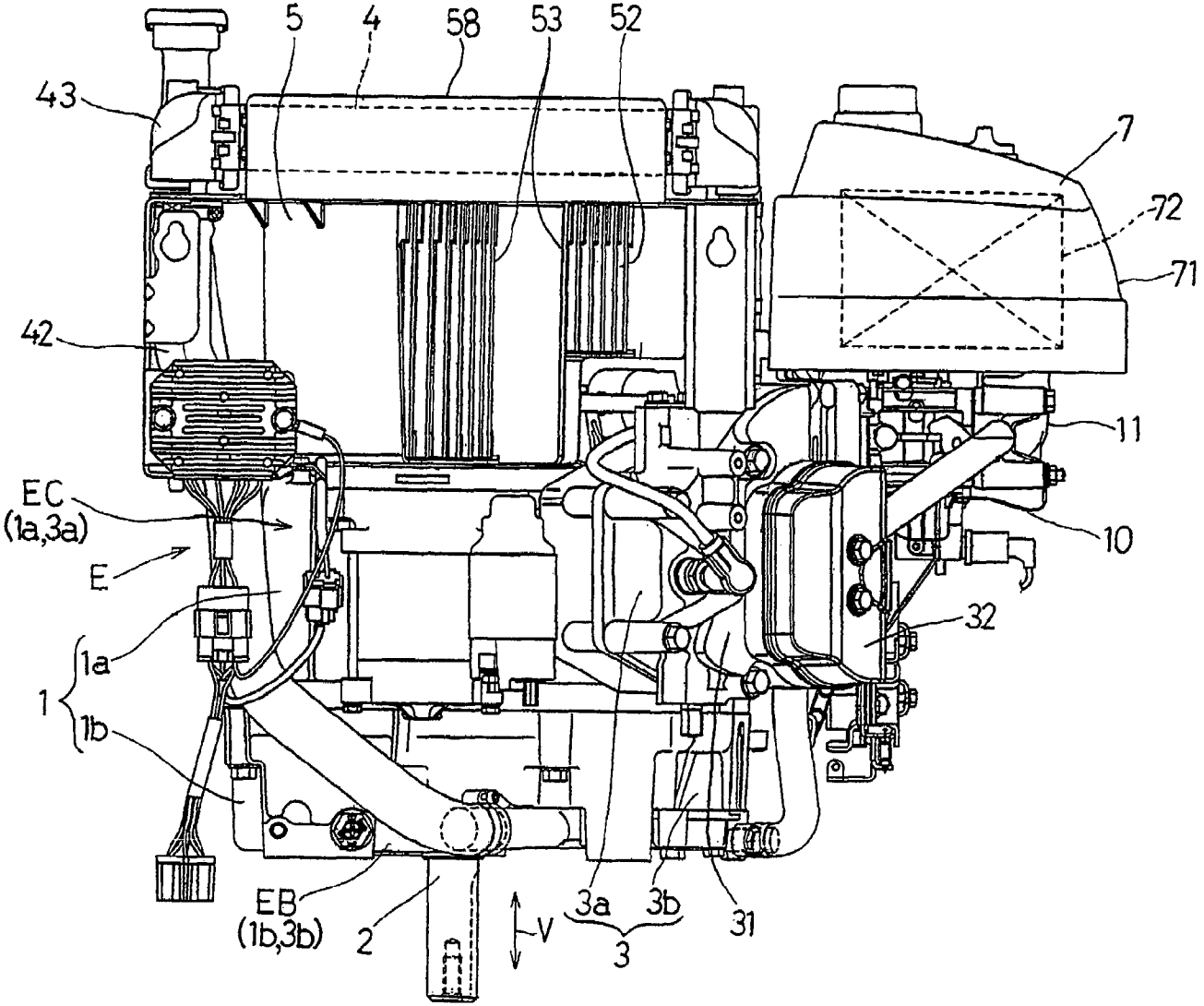
FIG. 1 is a right side view of a liquid-cooled, vertical shaft type combustion engine according to a preferred embodiment of the present invention.

A preferred embodiment of the present invention will now be described with particular reference to the accompanying drawings. A liquid-cooled, vertical shaft type two-cylinder internal combustion engine of a V-type configuration shown in FIG. 1 includes an engine body E including a crankcase 1, engine cylinders 3, cylinder heads 31 and a rocker cover 32. A crankshaft 2 is rotatably supported within the crankcase 1 of the engine body E so as to extend substantially vertically, and the engine cylinders 3 and the cylinder heads 31 are arranged at a front portion of the engine body E. A radiator 4 for cooling a coolant used to cool the combustion engine is mounted atop the engine body E. It is to be noted that the term "substantially vertically" used in connection with the crankshaft 2 is intended to encompass not only the crankshaft 2 extending exactly vertically, but also that tilted a certain angle relative to the geometric vertical orientation.

Figure 2:
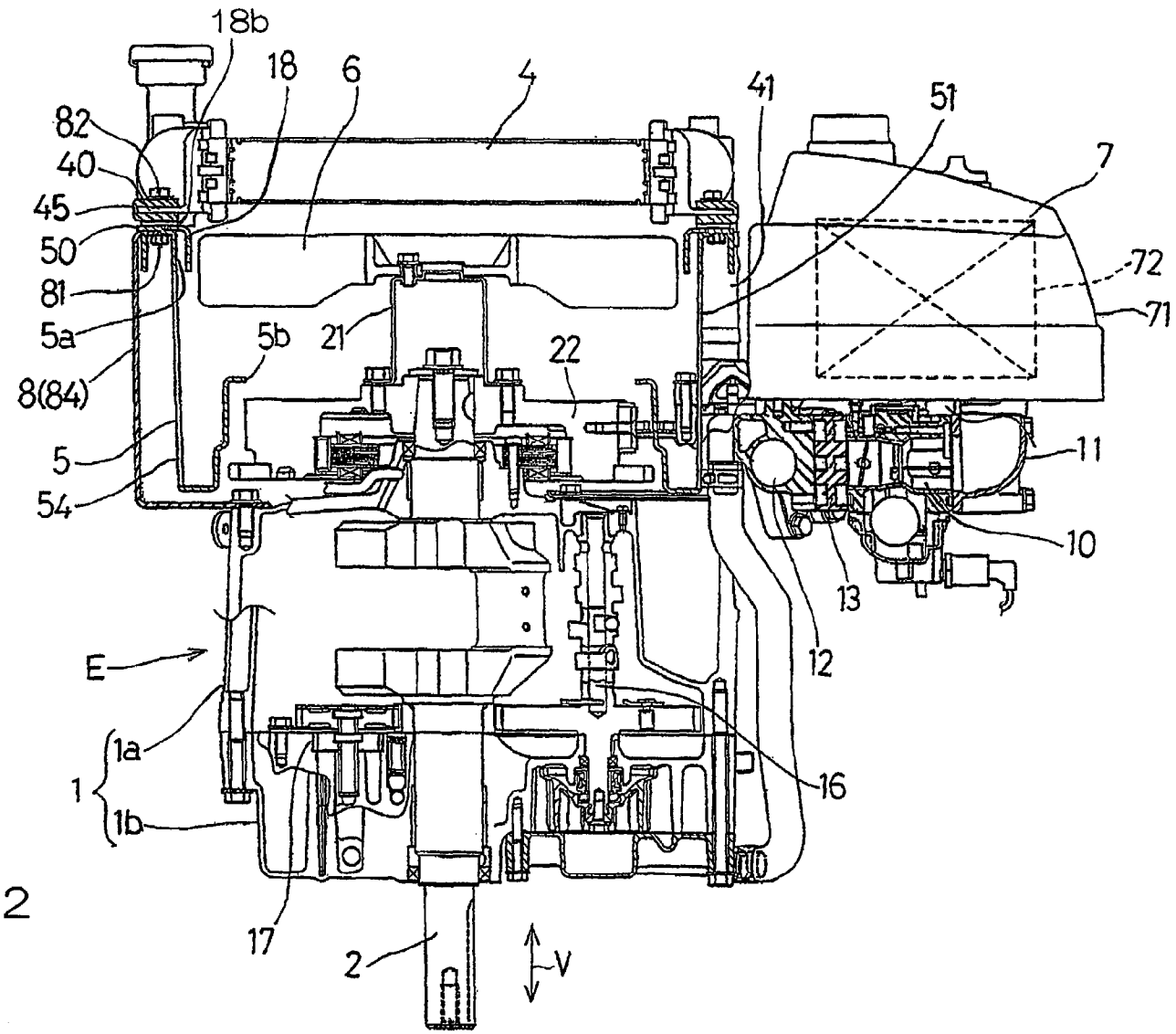
FIG. 2 is a longitudinal sectional view of the combustion engine of FIG. 1, showing an internal structure thereof.

A duct 5 and a cooling fan 6, accommodated within the duct 5 as shown in FIG. 2, are arranged below the radiator 4. An air cleaner unit 7 is disposed at a location radially outwardly of the duct 5 and forwardly of the engine body E, which air cleaner unit 7 includes an air cleaner case 71 accommodating herein a filter element 72. The radiator 4 referred to above is fluidly connected with an inlet tube 41 (FIG. 2), through which a coolant water having been heated as a result of cooling of the engine body E is introduced into the radiator 4, and an outlet tube 42 through which the coolant water having circulated within the radiator 4 with the heat dissipated in exchange of a cooling air is supplied to the engine body E by way of a tank 43 of the radiator 4.

As described above, the engine body E includes the crankcase 1, the engine cylinders 3, the cylinder heads 31 and the rocker cover 32. Specifically, an upper half 1*a* of the crankcase 1 and a major portion 3*a* of each of the engine cylinders 3 are integrated together into an engine casing EC. On the other hand, a lower half 1*b* of the crankcase 1 and another portion 3*b* of each engine cylinder 3 are integrated together into an engine base EB, which is firmly secured to a bottom of the engine casing EC.

As shown in FIG. 2, the duct 5 has top and bottom ends 5*a* and 5*b* opening upwardly and downwardly, respectively. The top open end 5*a* of the duct 5 has an inner diameter somewhat greater than the outer diameter of the cooling fan 6, whereas the bottom open end 5*b* thereof has an inner diameter substantially equal to the outer diameter of a flywheel 22 fixedly mounted on the crankshaft 2. The hollow of the duct 5 delimited between the top and bottom open ends 5*a* and 5*b* defines a space for accommodating the cooling fan 6 and a pulley 21 through which the fan 6 is mounted on the crankshaft 2. This duct 5 has a plurality of, for example, four, mounting tongues 50 formed in an outer periphery of the duct 5, through which the duct 5 is fixed to the engine body E by means of a bracket 8. More specifically, the four mounting tongues 50 of the duct 5 and four mounting tongues 40, formed in four corner areas of the radiator 4, are overlapped one above the other through corresponding damper members 45 and are in turn fixed in position on the bracket 8 by means of screw members 82 each firmly threaded into a corresponding nut 81 welded to the bracket 8.

Figure 7:
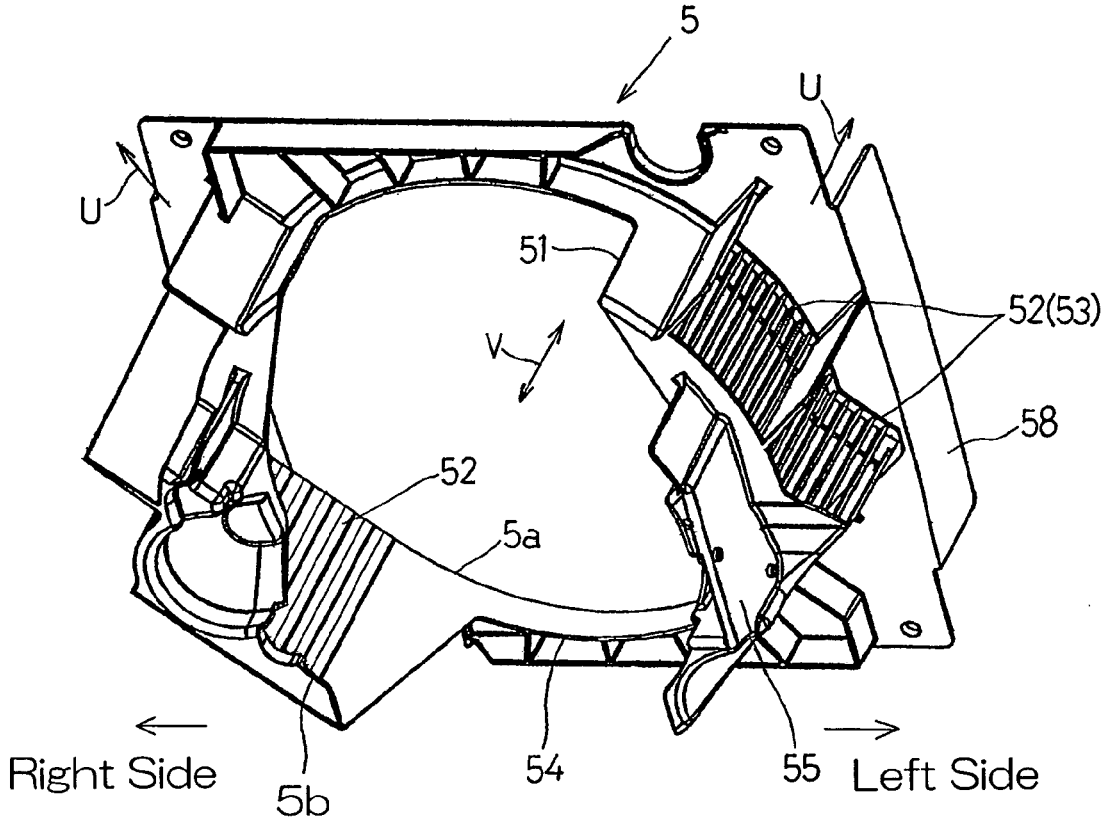
FIG. 7 is a perspective view of the duct employed in the combustion engine.
Figure 8:
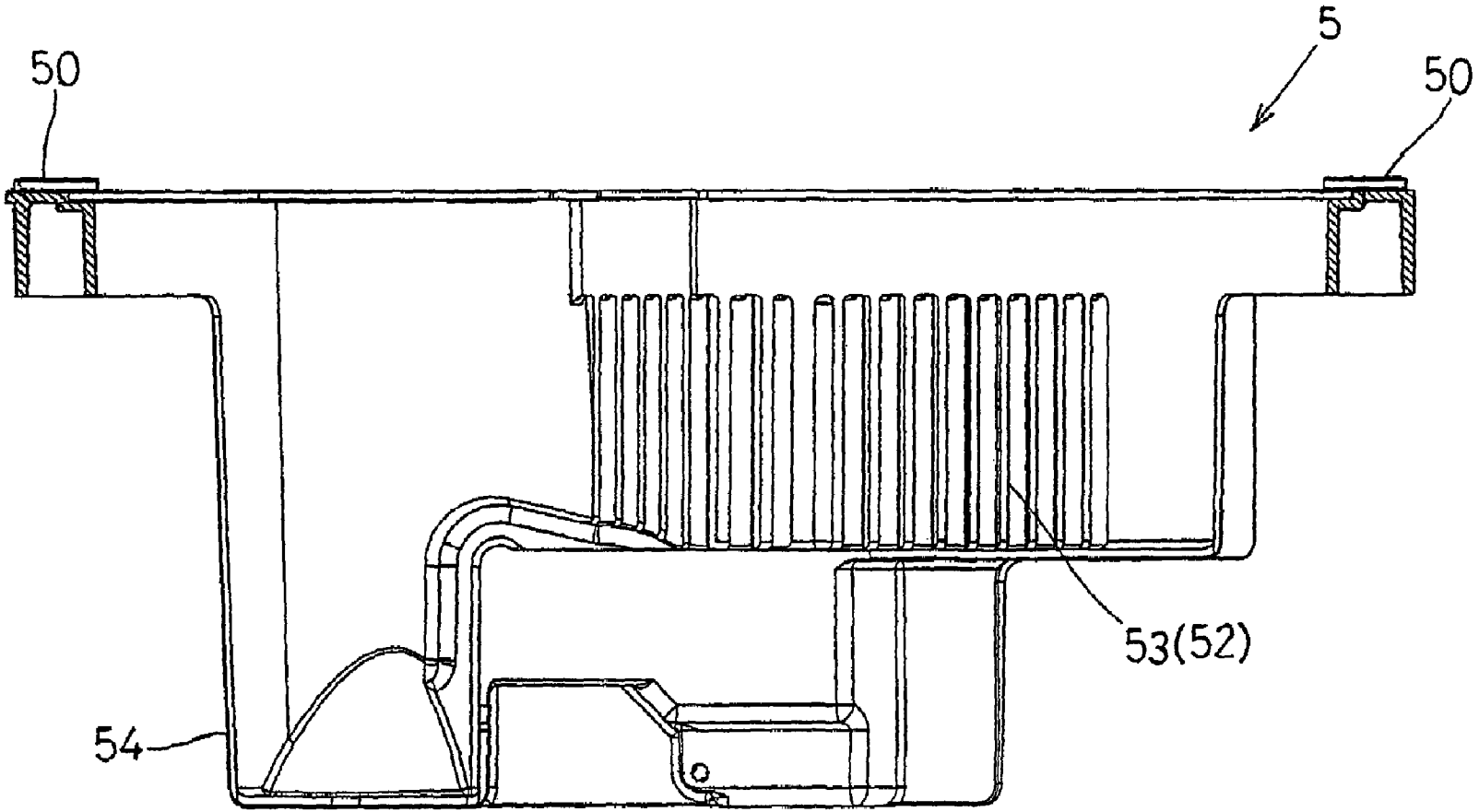
FIG. 8 is a right side view of the duct shown in FIG. 7.

Referring now to FIG. 7, the duct 5 has a round hollow defined in a generally central portion thereof for accommodating the cooling fan 6, shown in FIG. 2, and includes a peripheral wall having a front portion, depleted to define a front discharge opening 51 from which a stream of cooling air induced by the cooling fan 6 can be discharged in a direction forwardly of the engine body E, and a rear portion depleted to define a rear discharge opening 54. Also, side portions of the peripheral wall of the duct 5 on respective sides of the front discharge opening 51 are formed respectively with side discharge ports 52 from which the stream of cooling air so induced can be discharged in a direction slantwise forwardly of the engine body E. The side discharge ports 52 are formed integrally with, or otherwise provided in any suitable manner with, respective louvers 53 so that the stream of cooling air induced by the cooling fan 6 can be forcibly discharged in a direction slantwise forwardly of the engine body E. The duct 5 also has left and right upright walls 58 rigidly secured to or otherwise formed integrally therewith so as to extend upwardly.

Figure 3:
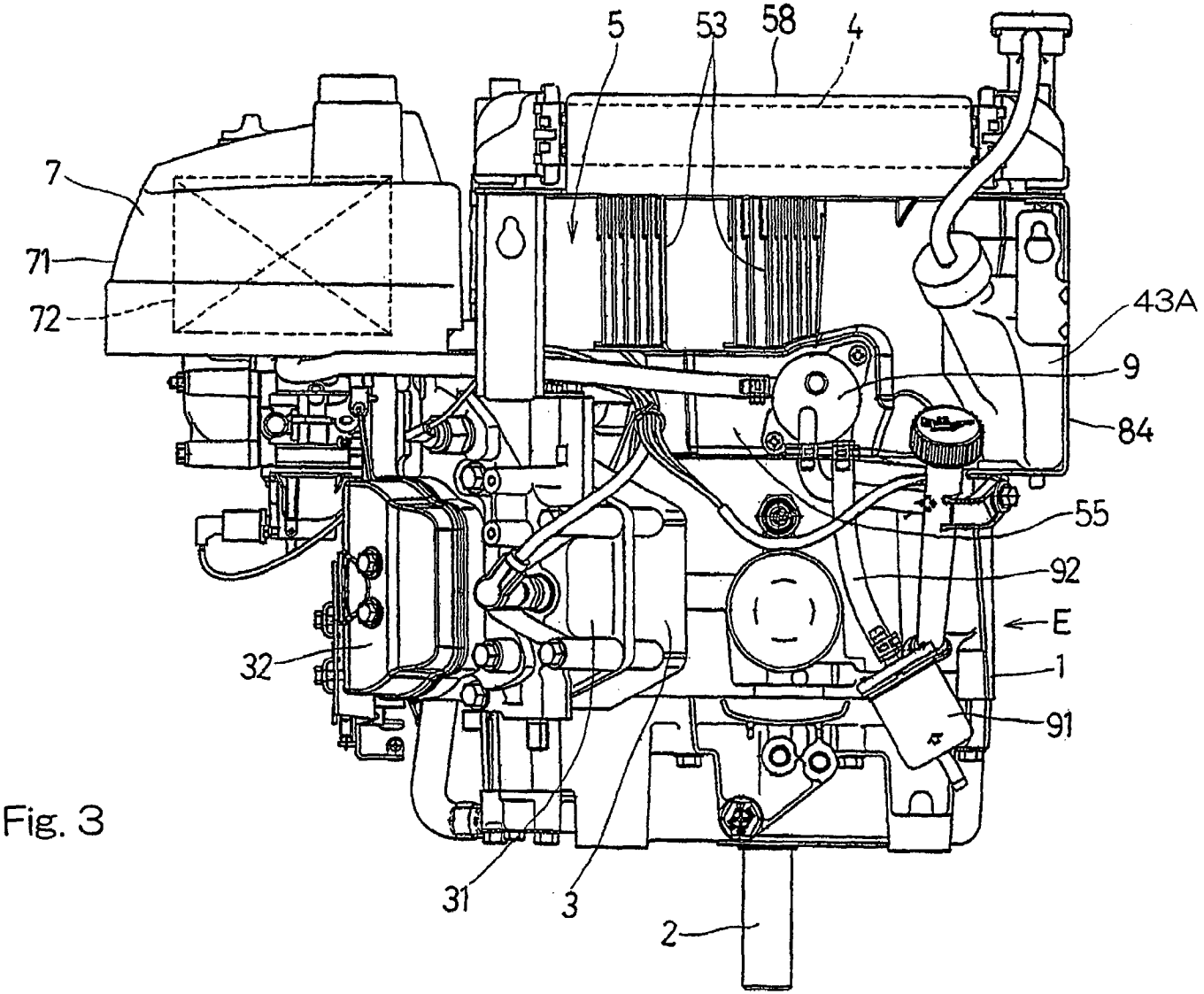
FIG. 3 is a left side view of the combustion engine.

A lower portion of the left-hand louver 53, or the right-hand louver 53 as viewed in FIG. 7, provided in the peripheral wall of the duct 5 is formed as a shielding plate 55 having an outer surface to which a fuel pump shown in FIG. 3 is secured. Accordingly, the fuel pump 9 will not be adversely affected by not only the stream of cooling air flowing through the duct 5 but also heats evolved by the engine cylinders 3 and the cylinder heads 31 and, therefore, the fuel pump 9 can be kept at a proper temperature performing a required pumping function. The fuel pump 9 is in the form of a diaphragm pump and is driven by the pressure inside a crank chamber of the crankcase 1. This fuel pump 9 is fluidly connected with a fuel filter 91 through a tubing 92, as shown in FIG. 3.

The duct 5 of FIG. 7 including the louvers 53 is made of a synthetic resin such as polypropylene by means of any known plastic molding technique, with the use of a mold assembly having first and second die moving directions, which conform respectively to a vertical direction V and a slantwise forward direction U in which portions of the stream of cooling air emerging horizontally outwardly from the louvers flow. In other words, the duct 5 employed in the embodiment is formed with the use of a mold assembly having a cavity so shaped and so defined as to provide not only the hollow of the duct 5 extending in a substantially vertical direction V between the top and bottom open ends 5*a* and 5*b* thereof, but also the side discharge ports 52 including the respective louvers 53 and oriented to allow the stream of cooling air to be discharged in a horizontal direction slantwise forwardly of the engine body E. Accordingly, the mold assembly used to manufacture the duct 5 can be simplified in structure with a cost of manufacture thereof consequently lowered, resulting in reduction of the cost of manufacture of the ducts 5.

As best shown in FIG. 2, the air cleaner unit 7 has a substantial height ranging from a point intermediate of the height of the duct 5, delimited between the top and bottom open ends 5*a* and 5*b* thereof, to a point generally in flush with a top surface of the radiator 4. A fuel supply device 10 such as a carburetor or a fuel injection device is arranged beneath the air cleaner unit 7 and is fluidly connected with the air cleaner 7 through an intake pipe 11. This fuel supply device 10 is on the other hand fluidly connected with an intake manifold 12 through an insulator 13. The fuel supply device 10 and the intake pipe 11 include two intake passages communicated respectively with the engine cylinders. A camshaft 16 and an oil pump 17, both drivingly connected with and adapted to be driven by the crankshaft 2 through a gear train (not shown), are accommodated within the crankcase 1.

Figure 4:
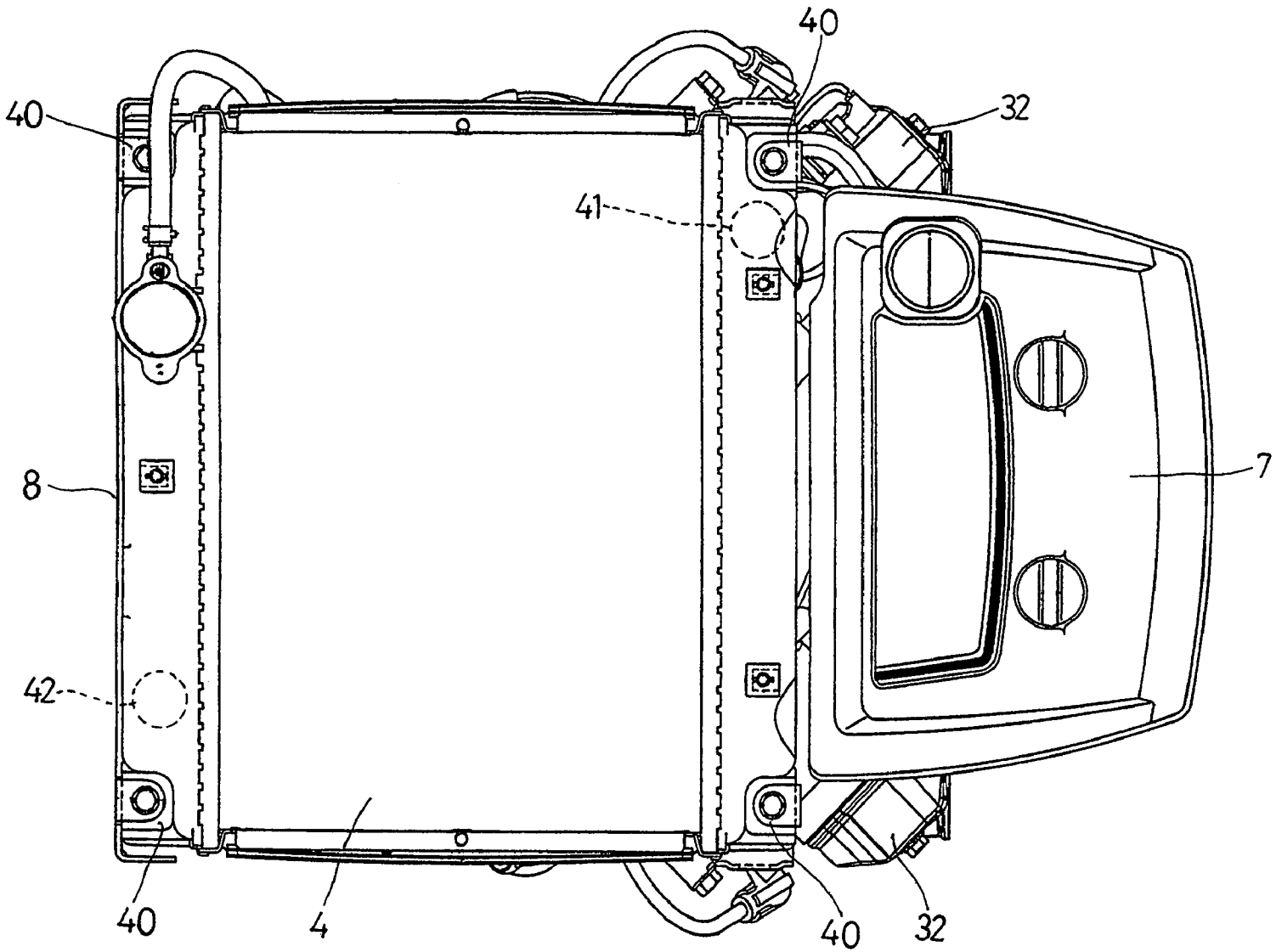
FIG. 4 is a top plan view of the combustion engine.
Figure 5:
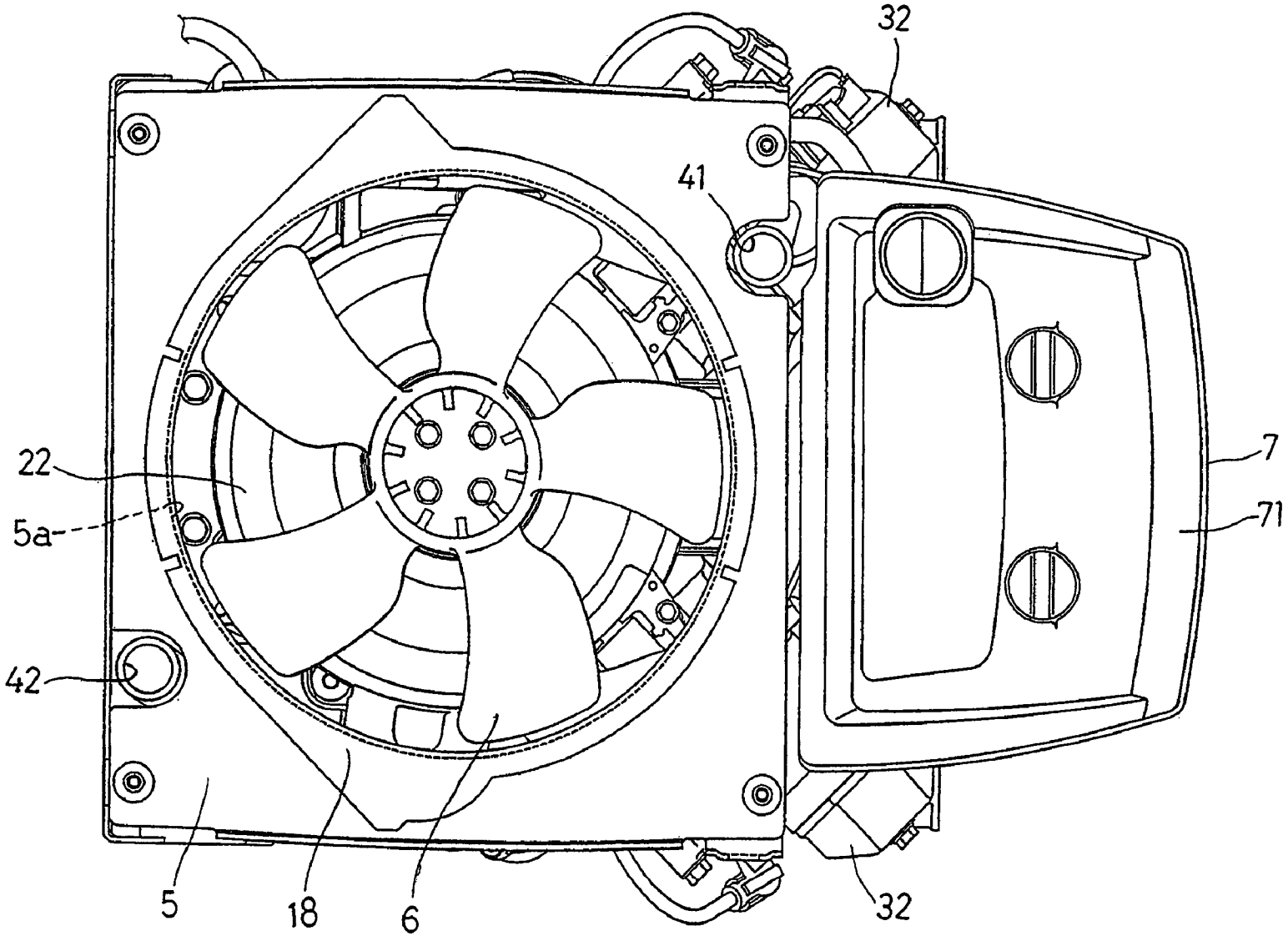
FIG. 5 is a top plan view of the combustion engine, with a radiator removed away.

The radiator 4 and the air cleaner unit 7 positioned forwardly of the radiator 4, when viewed from top, represent a rectangular shape and a generally transversely elongated trapezoidal shape, respectively, as best shown in FIG. 4. As shown in FIG. 5 showing the cooling fan 6 with the radiator 4 removed away, the cooling fan 6 is exposed to the outside through the top open end 5*a* of the duct 5. A ring-shaped guide body 18 is mounted inside the duct 5 and has an axial length sufficient to encircle at least an upstream or upper portion of an outer periphery of the cooling fan 6 as shown in FIG. 2 with respect to the direction of flow of the stream of cooling air through the duct 5. As shown therein, the guide body 18 has a radially outwardly protruding flange 18*b* (FIG. 9), which is sandwiched between the mounting tongues 40 of the radiator 4 and the mounting tongues 50 of the duct 5 and is therefore retained in position by the duct 5. It is, however, to be noted that the guide body 18 may have an axial length sufficient to encircle the cooling fan 6 in its entirety.

Figure 9:
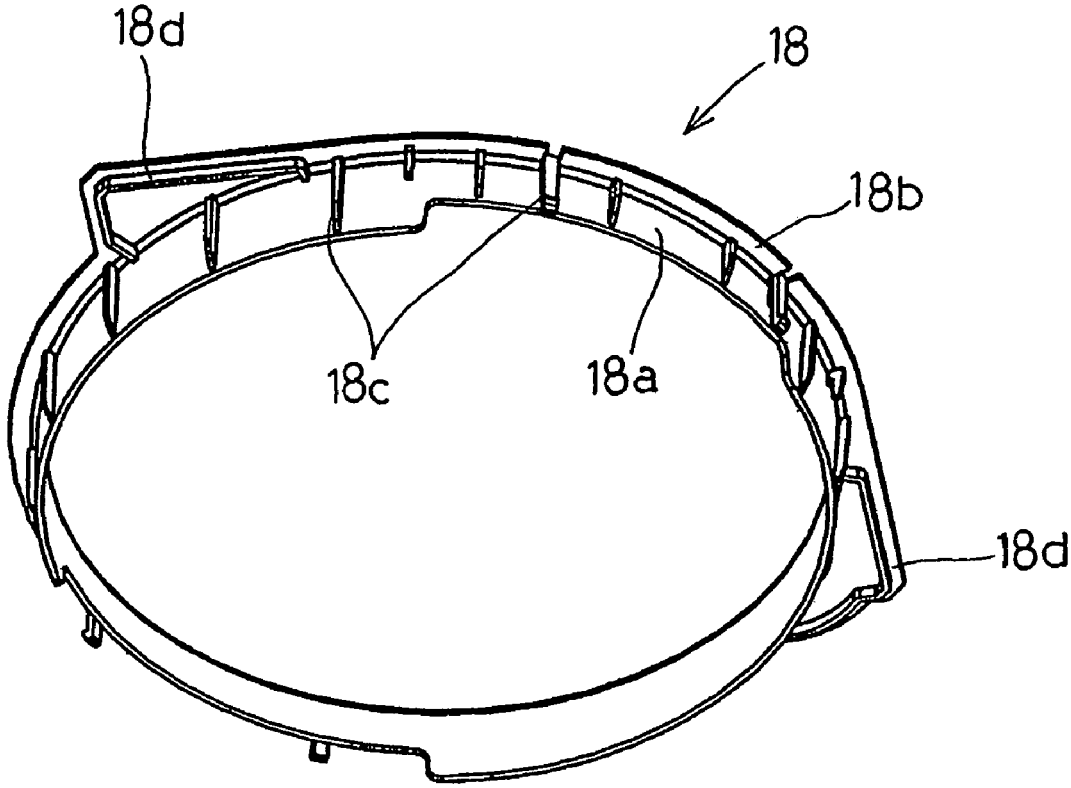
FIG. 9 is a perspective view of the guide body employed in the combustion engine.

FIG. 9 illustrates the details of the guide body 18 referred to above. As best shown therein, the guide body 18 is of one-piece construction molded of a synthetic resin by the use of any known molding technique, including an annular wall 18*a* mounted in the top open end 5*a* of the duct 5 and the radially outwardly protruding flange 18*b* lying perpendicular to the annular wall 18*b*. This guide body 18 also includes a plurality of reinforcement ribs 18*c* formed integrally with an outer peripheral surface thereof and spaced a predetermined distance from each other in a direction circumferentially thereof. In order for the guide body 18 to be easily removed or mounted relative to the duct 5, the guide body 18 is formed integrally with a pair of handles 18*b* protruding radially outwardly from the flange 18*b*. With the guide body 18 mounted inside the duct 5, the tip clearance defined between the guide body 18 and the cooling fan 6 can advantageously be set to a relatively small value effective to increase the cooling performance.

Figure 6:
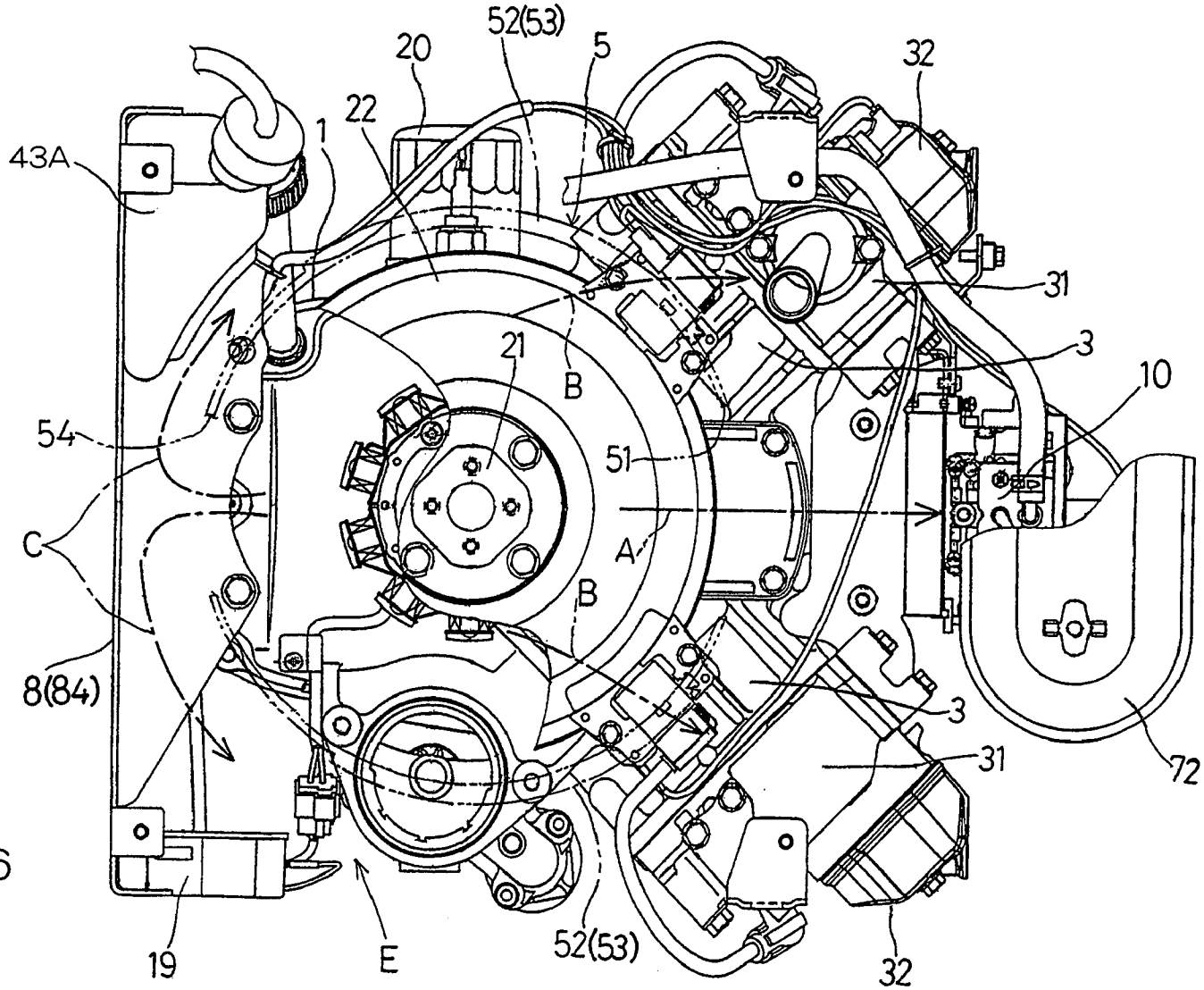
FIG. 6 is a top plan view of the combustion engine, with a guide body, a duct and a cooling fan removed away.

FIG. 6 illustrates a top plan view of the combustion engine, with the air cleaner case 71, the duct 5 and the cooling fan 6 removed away. As shown therein, two engine cylinders 3 are arranged in a generally V-shaped layout in a horizontal plane with an angle of, for example, 90° formed therebetween, and the fuel supply device 10 is disposed between those engine cylinders 3 with the cleaner element 72 positioned above the fuel supply device 10. The stream of cooling air emerging outwardly from the louvers 53 of the side discharge ports 52 of the duct 5 flows towards the engine cylinders 3 and the cylinder heads 31 in a direction shown by the arrows B.

An oil filter 20 is disposed on a left side outer surface of the crankcase 1 and a regulator 19 for electric charging and a reserve tank 43 for reserve coolant water are arranged rearwardly of the engine body E. The bracket 8 positioned rearwardly of the duct 5 is held in proximity of an outer side of the rear discharge opening 54 of the duct 5 and concurrently serves as a guide plate 84 for deflecting the stream of cooling air, emerging outwardly from the rear discharge opening 54, to flow in a direction laterally thereof.

With the liquid-cooled, vertical shaft type combustion engine of a V-type configuration constructed as hereinbefore described, the cooling fan 6, shown in FIG. 2, when driven draws therethrough a stream of air from the outside of the engine as a cooling air. As the stream of cooling air flows through the radiator 4, the coolant water circulating within the radiator 4 is cooled in heat exchange with the cooling air and, thereafter, the cooling air enters the duct 5. As shown in FIG. 6, the stream of cooling air flowing through the duct 5 is subsequently discharged in part from the front discharge opening 51 in a forward direction shown by the arrow A and in part from the side discharge ports 52 by way of the respective louvers 53 in a direction slantwise forwardly of the engine body E as shown by the arrow B.

A portion of the stream of cooling air discharged from the front discharge opening 51 impinges directly on the fuel supply device 10 (FIG. 2) and the remaining portion of the stream impinges on the air cleaner case 71 of the air cleaner unit 7 and then on the fuel supply device 10 after having been deflected by the air cleaner case 71 so as to travel downwardly therefrom, thereby accomplishing an efficient cooling of the fuel supply device 10. On the other hand, the stream of cooling air emerging outwardly from the louvers 53 travels towards the engine cylinders 3 of the V-shape arrangement and the associated cylinder heads 31 to thereby cool not only the engine cylinders 3 and the associated cylinder heads 31 but also the rocker cover 32.

The stream of cooling air is also discharged in part outwardly from the rear discharge opening 54 and is then deflected by the guide plate 84, positioned rearward of the rear discharge opening 54, so as to flow in two lateral directions shown by the respective arrows C to thereby cool the electric charge regulator 19. The stream of cooling air is furthermore discharged in part outwardly downwardly from the lower open end 5*b* of the duct 5 (FIG. 2) and is used to cool the crankcase 1 and the oil filter 20 (FIG. 6) and may, in the case of the working vehicle, flow towards a muffler (not shown), disposed beneath a frame structure for the support of an engine body, to cool the muffler.

The water-cooled, vertical shaft type combustion engine of the structure described hereinabove makes use of the duct 5 of a type having the top and bottom open ends (5*a* and 5*b*) and front and rear discharge openings (51 and 54) as shown in FIG. 2. Since this duct 5 is not provided with any air stream guide such as employed inside the conventionally used duct for deflecting the stream of cooling air to travel forwardly of an engine body, the duct 5 employed in the practice of the present invention can advantageously be molded compact in size with a simplified structure. Specifically, the duct 5 employed in the practice of the present invention is of one-piece construction as hereinbefore described, not of a multi-piece construction using a combination of separate duct components, and, therefore, the number of duct component parts can advantageously be reduced, accompanied by reduction in cost of manufacture of the duct 5.

Also, the stream of cooling air induced by the cooling fan 6 is discharged in the forward horizontal direction shown by the arrow A (FIG. 6), the slantwise forward horizontal direction shown by the arrows B (FIG. 6) and the downward direction and is effectively utilized to cool not only the radiator 4 but also the various parts of the engine body E. In addition, since the air cleaner unit 7 is disposed at a location radially outwardly of the duct 5, the air cleaner unit 7 can have an increased thickness in the vertical direction that generally corresponds to the sum of the axial length of the duct 5 plus the thickness of the radiator 4, allowing the air cleaner unit 7 to have an increased cleaning performance without an increase in height of the combustion engine as a whole.

Furthermore, the guide body 18, not the duct 5 by itself, allows the proper tip clearance to be secured between it and the outer periphery of the cooling fan 6. Accordingly, by preparing a different size guide body 18 designed in accordance with the teachings of the present invention for use with a similar engine having a different rated output and hence employing a cooling fan 6 of a different diameter because of a different cooling performance required, the proper tip clearance can be obtained while a common duct 5 is used. This can readily be accomplished merely by replacement of the guide body 18 with the different size guide body 18. Accordingly, the costs of manufacture of the numerous engines can advantageously be reduced.

In addition, the stream of cooling air discharged outwardly from the rear discharge opening 54 is deflected by the guide plate 84 (i.e., the bracket 8) so as to flow in the two lateral directions C and, accordingly, where the combustion engine is mounted on a front portion of the lawn tractor with the front of the combustion engine oriented forwards, the stream of cooling air emerging outwardly from the rear discharge opening 54 is in no way directed towards a driver's seat at a rear portion of the lawn tractor, allowing the driver to perform a job of lawn mowing comfortably.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A liquid-cooled, vertical shaft type combustion engine, which comprises:

an engine body;

a crankshaft accommodated in the engine body and having a longitudinal axis oriented substantially vertically;

at least one engine cylinder head disposed at a front portion of the engine body;

a radiator mounted above the engine body for cooling the engine body;

a duct positioned below the radiator; and a cooling fan operatively accommodated within the duct;

wherein the duct has a peripheral wall and top and bottom open ends and also has at least a front discharge opening and side discharge parts defined in a front portion and side portions, respectively, of the peripheral wall for discharging a stream of cooling air, that is induced by the cooling fan and flows into the radiator upstream of the cooling fan and then enters the duct to flow in a direction forwardly of the engine body and in a direction slantwise forwardly of the engine body, respectively.

2. The liquid-cooled, vertical shaft type combustion engine as claimed in claim 1, further comprising a fuel supply device and wherein the front discharge opening confronts the fuel supply device.

3. The liquid-cooled, vertical shaft type combustion engine as claimed in claim 1, further comprising an air cleaner unit disposed radially outwardly of the duct.

4. The liquid-cooled, vertical shaft type combustion engine as claimed in claim 1, wherein the duct also has a rear discharge opening defined in a rear portion of the peripheral wall of the duct, and further comprising a bracket for supporting the radiator on the engine body, the bracket concurrently serving as a guide plate that is positioned outwardly of and in the vicinity of the rear discharge opening for guiding the stream of cooling air in a direction laterally of the duct.

5. The liquid-cooled, vertical shaft type combustion engine as claimed in claim 1, wherein the duct includes a guide body mounted therein and encircling at least an upstream portion of an outer periphery of the cooling fan accommodated within the duct.

6. The liquid-cooled, vertical shaft type combustion engine as claimed in claim 1, wherein the duct includes a louver provided in each of the side discharge ports of guiding the stream of cooling air to flow slantwise forwardly of the engine body.

7. The liquid-cooled, vertical shaft type combustion engine as claimed in claim 6, wherein the duct including the louvers is formed of a synthetic resin, using a mold assembly having first and second die moving directions, which conform respectively to a vertical direction and a slantwise forward direction in which portions of the stream of cooling air emerge outwardly from the louvers.

8. The liquid-cooled, vertical shaft type combustion engine as claimed in claim 1, wherein the engine is of a V-type configuration having engine cylinders disposed in a V-shape arrangement and wherein respective portions of the stream of cooling air emerging outwardly from the side discharge ports of the duct are directed towards the engine cylinders of the V-shape arrangement.

9. The liquid-cooled, vertical shaft type combustion engine as claimed in claim 1, further comprising a fuel pump disposed at a location below the side discharge ports in the peripheral wall of the duct.

10. In a liquid-cooled vertical shaft combustion engine having an engine body, a crankshaft extending substantially vertical, an engine cylinder head, a cooling fan mounted on top of the engine body and a liquid radiator mounted above the cooling fan for cooling the engine body, the improvement comprising;

an integral one-piece duct positioned around the cooling fan and below the radiator, the radiator mounted on top of the duct member, wherein the duct has a peripheral wall and top and bottom open ends and also has at least a front discharge opening and side discharge ports defined in a front portion and side portions, respectively, of the peripheral wall for discharging a steam of cooling air, that is induced by the cooling fan and flows into the radiator upstream of the cooling fan and then enter the duct to flow in a direction forwardly of the engine body and in a direction slantwise forwardly of the engine body, respectively.

11. The liquid-cooled vertical shaft combustion engine of claim 10 wherein the duct includes a guide body mounted therein and encircling at least an upstream portion of an outer periphery of the cooling fan accommodated within the duct and a rear discharge opening in a rear portion of the peripheral wall.

12. The liquid-cooled vertical shaft type combustion engine in claim 11 wherein the duct includes a louver provided in each of the side discharge ports for guiding the stream of cooling air to flow slantwise forwardly of the engine body.

13. The liquid-cooled, vertical shaft type combustion engine of claim 12 wherein the duct including the louvers is formed of a synthetic resin.

14. The liquid-cooled, vertical shaft type combustion engine of claim 13 wherein the duct has a flat rectangular perimeter upper surface adjacent the liquid radiator and a partial cylindrical lower configuration with the louvers formed in the lower configuration.

15. A liquid-cooled, vertical shaft type combustion engine, which comprises:

an engine body;

a crankshaft accommodated in the engine body and having a longitudinal axis oriented substantially vertically;

at least one engine cylinder head disposed at a from portion of the engine body;

a radiator mounted above the engine body for cooling the engine body;

a duct positioned below the radiator; and a cooling fan operatively accommodated within the duct;

wherein the duct has peripheral wall and top and bottom open ends and also has at least a front discharge opening, side discharge ports and a rear discharge opening defined in a front portion, side portions and a rear portion, respectively, of the peripheral wall for discharging a stream of cooling air, induced by the cooling fan to flow in a direction forwardly of the engine body, in a direction slantwise forwardly of the engine body and in a direction rearward of the engine body, respectively.

16. A liquid-cooled, vertical shaft type combustion engine, which comprises:

an engine body;

a crankshaft accommodated in the engine body and having a longitudinal axis oriented substantially vertically;

at least one engine cylinder head disposed at a front portion of the engine body;

a radiator mounted above the engine body for cooling the engine body;

a duct positioned below the radiator; and a cooling fan operatively accommodated within the duct;

wherein the duct has a peripheral wall and top and bottom open ends and also has at least a front discharge opening and side discharge ports defined in a front portion and side portions, respectively, of the peripheral wall for discharging a stream of cooling air, inducted by the cooling fan, in a direction forwardly of the engine body and in a direction slantwise forwardly of the engine body, respectively, the duct also has a rear discharge opening defined in a rear portion of the peripheral wall of the duct, and further comprising a bracket for supporting the radiator on the engine body, the bracket concurrently serving as a guide plate that is positioned outwardly of and in the vicinity of the rear discharge opening for guiding the steam of cooling air in a direction laterally of the duct.

17. A liquid-cooled, vertical shaft type combustion engine, which comprises:

an engine body;

a crankshaft accommodated in the engine body and having a longitudinal axis oriented substantially vertically;

at least one engine cylinder head disposed at a front portion of the engine body;

a radiator mounted above to engine body for cooling the engine body;

a duct positioned below the radiator; and a cooling fan operatively accommodated within the duct;

wherein the duct has a peripheral wall and top and bottom open ends and also has at least a front discharge opening and side discharge ports defined in a front portion and side portions, respectively, of the peripheral wall for discharging a stream of cooling air, inducted by the cooling fan, in a direction forwardly of the engine body and in a direction slantwise forwardly of the engine body, respectively, the duct also includes a guide body mounted therein and encircling at least an upstream portion of an periphery of the cooling fan accommodated within the duct.

* * * * *